United States Patent [19]

Kammerman et al.

[11] 4,279,414

[45] Jul. 21, 1981

[54] PLAYING COURT

[76] Inventors: Steven B. Kammerman, 11 Alscot Cir., Langhorne, Pa. 19047; Frank Kawasaki, 114 N. Woodstock St., Philadelphia, Pa. 19103; Albert G. Molloy, Jr., 114 Deepdale Rd., Wayne, Pa. 19087

[21] Appl. No.: 925,405

[22] Filed: Jul. 17, 1978

[51] Int. Cl.[3] ..... E04D 1/28; A63B 71/02

[52] U.S. Cl. ..... 272/3; 52/265; 52/225; 52/240; 52/309.8; 273/DIG. 1; 273/411

[58] Field of Search ..... 273/95 H, DIG. 1, 29 A, 273/411; 272/3; 52/309.8, 309.11, 265

[56] References Cited

U.S. PATENT DOCUMENTS

| | | | |
|---|---|---|---|
| 2,107,141 | 2/1938 | Colt | 272/3 |
| 3,695,618 | 10/1972 | Woolley et al. | 272/DIG. 1 |
| 4,063,395 | 12/1977 | Stewart et al. | 52/309.8 X |
| 4,068,840 | 1/1978 | Spaulding | 272/3 |

OTHER PUBLICATIONS

"Machine Digest", Nov. 26, 1959, pp. 152–154.

*Primary Examiner*—George J. Marlo

[57] ABSTRACT

A uniquely constructed playing court having a generally rectangular configuration comprising front, rear and side walls and/or ceiling wherein the front and side walls are a composite of integrated prefabricated panels, the inner facing surfaces of said panels being sheets which, according to one highly unique aspect of the invention, are of polycarbonate material, said sheets being mounted upon corrugated members whose corrugations are filled with a high density foam and the space surrounding said corrugations is filled with a low density foam. Vertical conventional studs are used to mount the panels by using appropriate fastening means between the studs and the rear surface of the panels. In a particular configuration, clips are welded to the inner facing flanges of the studs, and mating clips are welded to the apices of the corrugations of the corrugated backing sheet so that the panels may be attached upon the studs in adjacent and adjoining relationship. The rear wall of the court may be transparent and consists of a single thickness of polycarbonate sheet. The upper portion of the polycarbonate sheet of the rear wall is secured within a channel in a manner to permit the sheet to depend therefrom thus producing vertical tension upon the sheet due to its weight. In an alternate form, vertical tension is mechanically applied to the polycarbonate sheet.

5 Claims, 11 Drawing Figures

PLAYING COURT

BACKGROUND OF THE INVENTION

This invention relates to playing courts, for example squash, handball and racquet ball courts, wherein a ball (in squash and handball of moderately hard rubber; in racquet ball, of somewhat softer rubber) is played from some or all of the four walls and/or ceiling encompassing the players. For illustrative purposes, a squash court conventionally consists of a forward or front wall whose playing surface has a height of sixteen feet and a width of eighteen feet, six inches (twenty feet by forty feet for racquet ball and handball). The playing surface of the side walls extend rearwardly at the sixteen foot height for twenty-two feet, proceeding rearwardly for an additional ten feet at a height of twelve feet for a total length of thirty-two feet (twenty feet by forty feet for racquet ball and handball). The rear wall, which includes a door for access to the court, has a playing surface height of six feet, six inches (twelve feet for racquet ball and handball), and is sometimes made of glass so that spectators may view the play.

Typically, with the exception noted above respecting the use of glass for the rear wall, the playing surfaces of such courts (e.g. the inner facing surfaces of the walls) are constructed by lining the walls with blocks of maple, with the edge grain thereof providing a tough, resilient playing surface having the right "bounce" for play.

Unfortunately, these courts are initially expensive to construct and are difficult and expensive to maintain. For example, a squash court of conventional design at the present date could represent an initial capital investment of say, $25,000 (exclusive of the building in which it is erected) and could incur additional annual maintenance fees of approximately $2,000. When it is considered that clubs and other commercial recreational facilities invariably include many such courts, the initial cost of investment and continued maintenance is staggering.

Attempts have heretofore been made to substitute other materials for those conventionally used, without great success. For example, playing surfaces have been attempted by using coatings of enamel over a wood substrate in an attempt to minimize maintenance costs. Unfortunately, such surfaces do not have the frictional characteristics necessary to the achieving of the correct bounce, and balls when in play tend to skip. Furthermore, these surfaces, although relatively durable, will last for only a relatively short period of time.

Playing courts have been proposed wherein the walls and the playing surfaces thereof are entirely of glass. Although glass may be useful to permit spectator viewing, it is extremely expensive, and its inherent heaviness makes its support from a structural standpoint extremely difficult. U.S. Pat. No. 4,006,465 discloses a glass-walled court. U.S. Pat. Nos. 3,758,106 and 3,859,768 also teach various court constructions which are attempts to devise improved techniques of construction in order to overcome the problems associated with conventional design.

It is the purpose and objective of the present invention to describe a novel playing court construction which not only is reasonable in cost to construct and is virtually maintenance free, but also provides a consistent playing surface which provides more consistent playing or "bounce" characteristics than conventional maple-lined courts, and is superior thereto in its surface uniformity. Also, there is more uniformity of the play between the side and rear wall (where rear wall is transparent) than occurs when conventional side walls and a glass rear wall are combined.

SUMMARY OF THE INVENTION

In accordance with the principles of the present invention, a uniquely constructed playing court having a generally rectangular configuration comprising front, rear and side walls and/or ceiling wherein the front and side walls are a composite of integrated prefabricated panels, the inner facing surfaces of said panels being sheets which, according to one highly unique aspect of the invention, are of polycarbonate material, said sheets being mounted upon corrugated members whose corrugations and the space surrounding said corrugations is filled with foam and/or other similar supportive substrate. Vertical conventional studs are used to mount the panels by using appropriate fastening means between the studs and the rear surface of the panels. In a particular configuration, clips are welded to the inner facing flanges of the studs, and mating clips are welded to the apices of the corrugations of the corrugated backing sheet so that the panels may be attached upon the studs in adjacent and adjoining relationship. The rear wall of the court may be transparent and consists of a single thickness of polycarbonate sheet. Means are provided for securing the upper portion of the polycarbonate sheet within a channel and for permitting the sheet to depend therefrom thus producing vertical tension upon a sheet due to its weight. In an alternate form, vertical tension is applied to a polycarbonate sheet by mechanical means.

DESCRIPTION OF A PREFERRED EMBODIMENT

Figure 1:
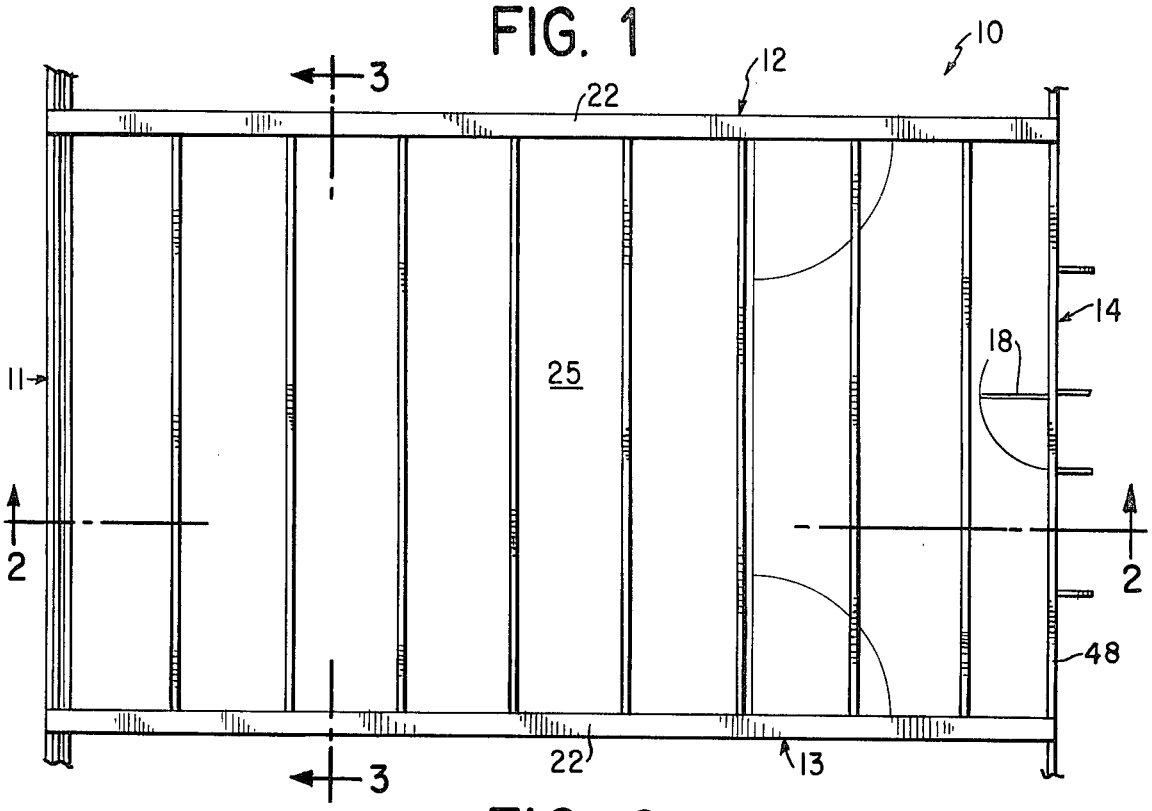
FIG. 1 is a plan view of a squash court constructed in accordance with the principles of the present invention.
Figure 2:
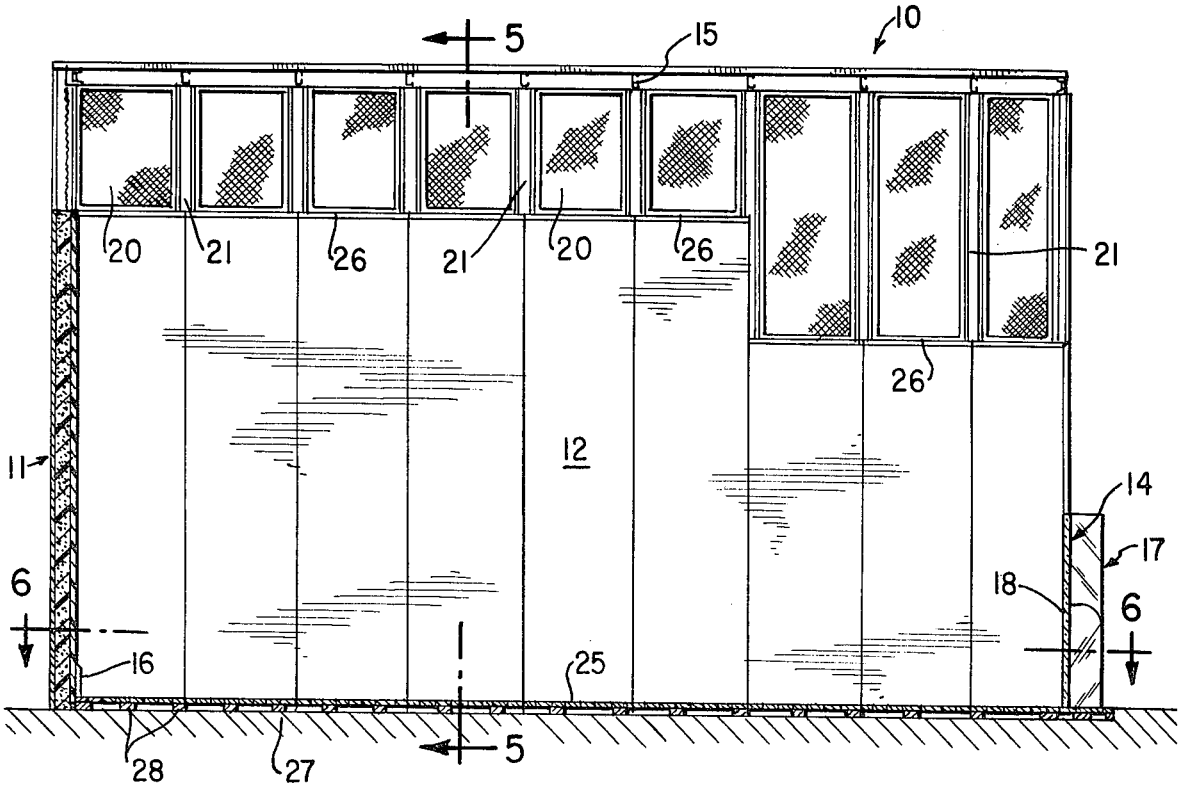
FIG. 2 is a longitudinal cross sectional view of the court according to FIG. 1.

Referring now to the drawing, FIG. 1 is a plan view of a squash court 10 constructed in accordance with the principles of the present invention. It will be understood that the construction of racquet ball and handball courts would be similar. The squash court includes a front wall 11 whose interior dimension is eighteen feet, six inches;

side walls 12 and 13 whose length is thirty-two feet; and a rear wall 14 of the same dimension as the front wall. Stringers 15 extend transversely across the top of walls 12 and 13. FIG. 2, which is a longitudinal cross sectional view of the court 10, illustrates that the side wall 12, as well as the side wall 13, extends for approximately two-thirds of the length of the court (actually for twenty-two feet) at the same height, i.e. sixteen feet, as the height of the front wall 11. Thereafter, the side walls 12 and 13 have a height of only twelve feet for the remaining ten feet of length. A telltale 16 extends along the interior base part of the front wall 11.

Figure 4:
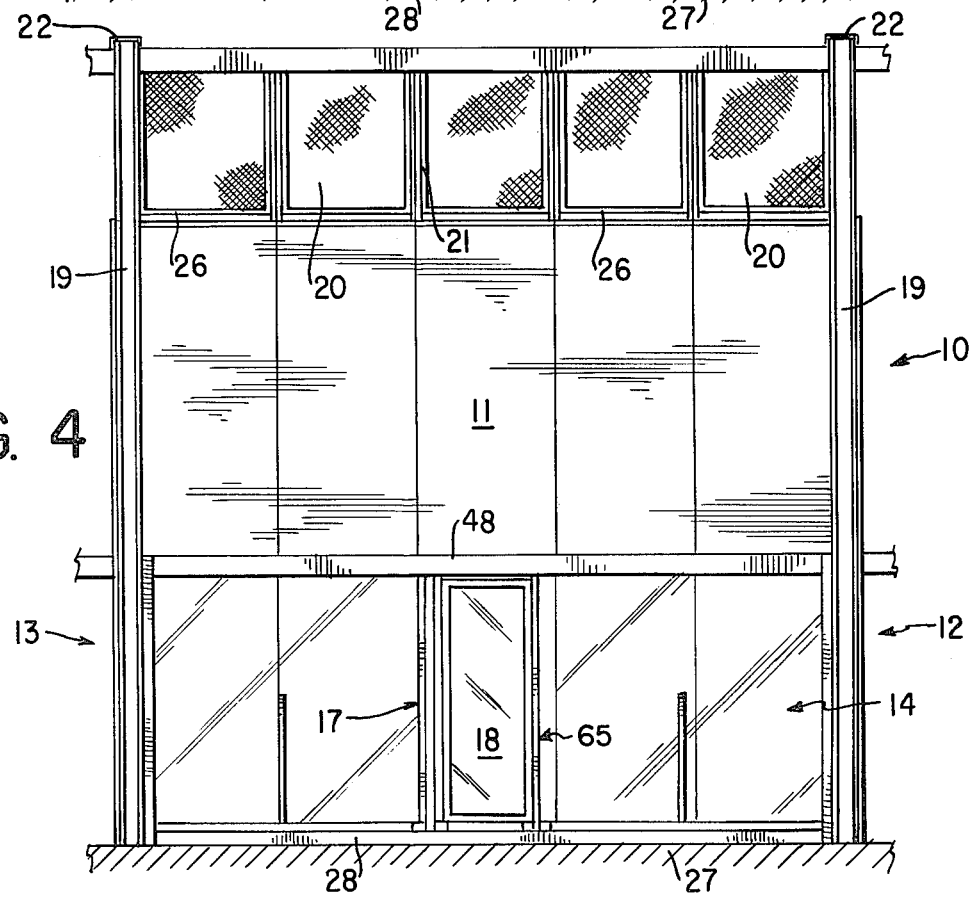
FIG. 4 is a rear elevation of the court of FIG. 1.

FIG. 4 is a rear elevation illustrating the height of the rear wall 14 at six feet, six inches, the wall 14 including a doorway 17 and a door 18 therein. Above the respective front and side walls 11–13, are studs 19 (which extend for the entire height of the wall) and attached thereto a mesh screen 20. The construction of the front and side walls is essentially the same and shall initially be described in detail. The rear wall 14 is transparent and of different construction and shall be described subsequently. It will be understood that although the drawing indicates courts arranged in side-by-side relationship, the description which follows shall be primarily of a single court.

Figure 5:
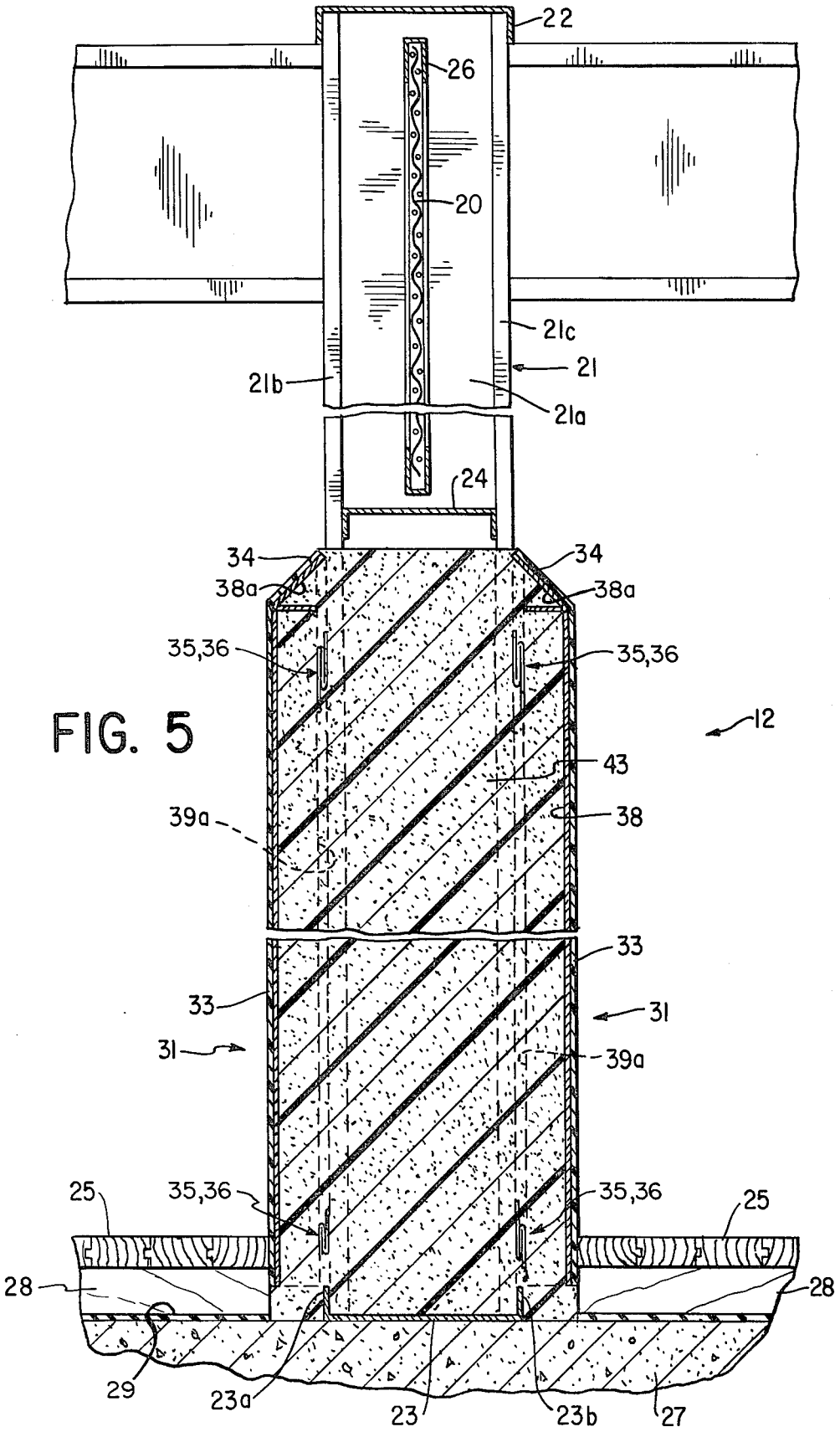
FIG. 5 is a view taken in the direction of arrows 5—5 of FIG. 2.

FIG. 5 is a vertical section taken through the side wall 12 and illustrates a typical construction of a vertical wall. A central supporting metal stud 21 approximately six inches in width has a central web **21*a* and two flanges 21*b*, 21*c* perpendicular thereto. The upper end of the stud 21 is retained within a continuous track 22, and a similar track 23 secures the lower end of the stud. At an intermediate height, perforated bridging elements 24 are mounted as stiffeners. Wire screening 20 is attached between the vertical web sections 21*a*, the wire screening being retained by a steel frame 26 which is attached and secured by appropriate fastening means to the central web sections 21*a* of each stud 21**.

As mentioned, the studs 21 are set into and retained at their bases by the continuous track 23, the latter resting upon a concrete or other base 27. Two-by-four transverse wooden sleepers 28 are placed upon rubber cushions 29. Conventional maple flooring 25 is laid upon sleepers 28.

In accordance with the present invention, the front and side walls of the court 10 comprise a plurality of adjoining prefabricated panels 31. Each panel comprises an inner facing sheet 33, which in the particular embodiment is made of polycarbonate known commercially under the trademark LEXAN. The method of manufacturing polycarbonate suitable for the described purpose will be found in U.S. Pat. No. 3,028,365; it being understood that sheets of such polycarbonate will be formed by causing the polycarbonate to be rolled or calendered into the appropriate thickness while the polycarbonate is in the plastic state. Polycarbonate has been chosen because of its resilience, great strength and resistance to impact and marring. It is relatively inexpensive and is virtually maintenance free. In addition to the characteristics just mentioned, it has been discovered that polycarbonate sheets properly mounted and supported in accordance with the present invention provide a truly accurate playing surface wherein the frictional characteristics of the surface and the resilience of the sheet are such that the "bounce" of the playing surface matches that of the conventional and traditional materials. Moreover, because of the uniformity of the surface and its resistance to defect both in its manufacture and during use, the surface is actually superior to prior conventional playing surfaces.

Figure 3:
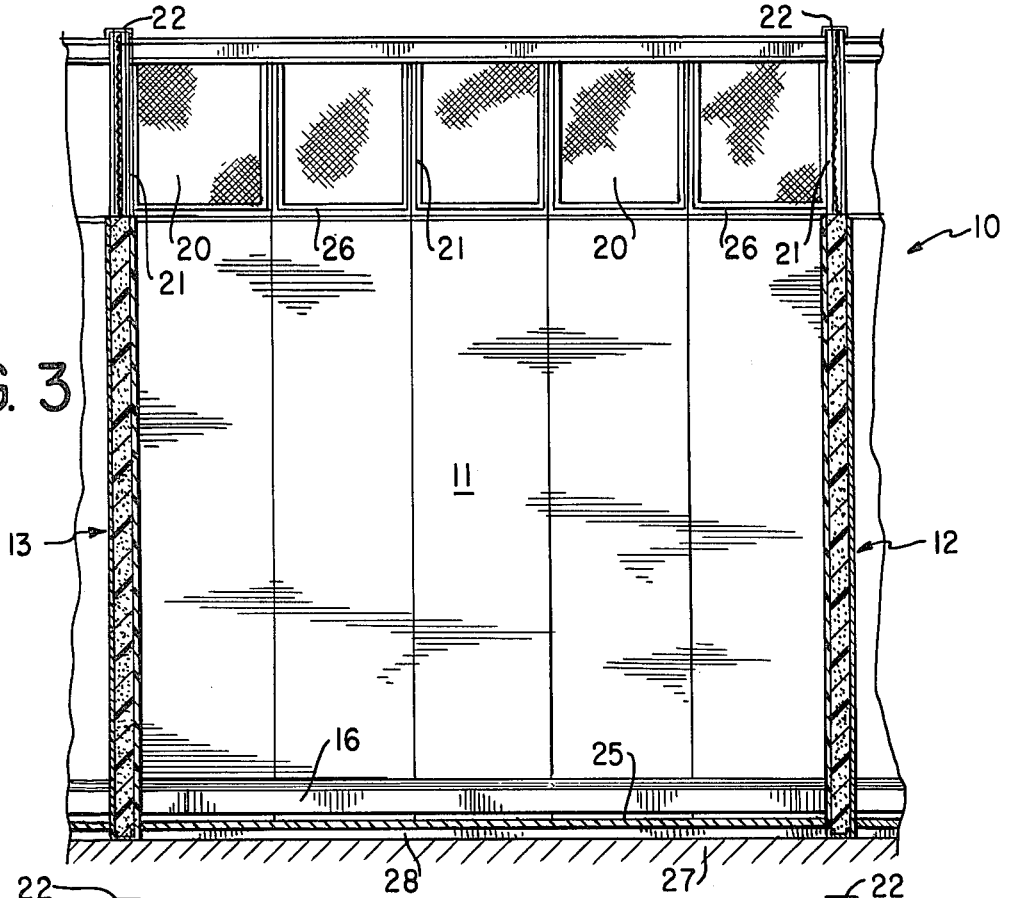
FIG. 3 is a view taken in the direction of arrows 3—3 of FIG. 1.

In the construction of a prefabricated panel 31, the polycarbonate sheet 33 may have, for example, a thickness in the order of one-eighth inch. Panels forming the front wall 11 are of essentially the same construction except that the polycarbonate facing sheet will be one-quarter inch thick. Because of the support provided by the invention as will be described, it will be understood that the section of the panel 31 taken with respect to FIG. 5 is typical and can be made to vary in height to accommodate the varying heights of the front and side walls as described in connection with FIGS. 1–3. Running along the top of the panel 31 will be an inclined strip 34, also of polycarbonate material, which will act to deflect a ball hitting strip 34 upwardly to indicate that it is out of play.

Figure 6:
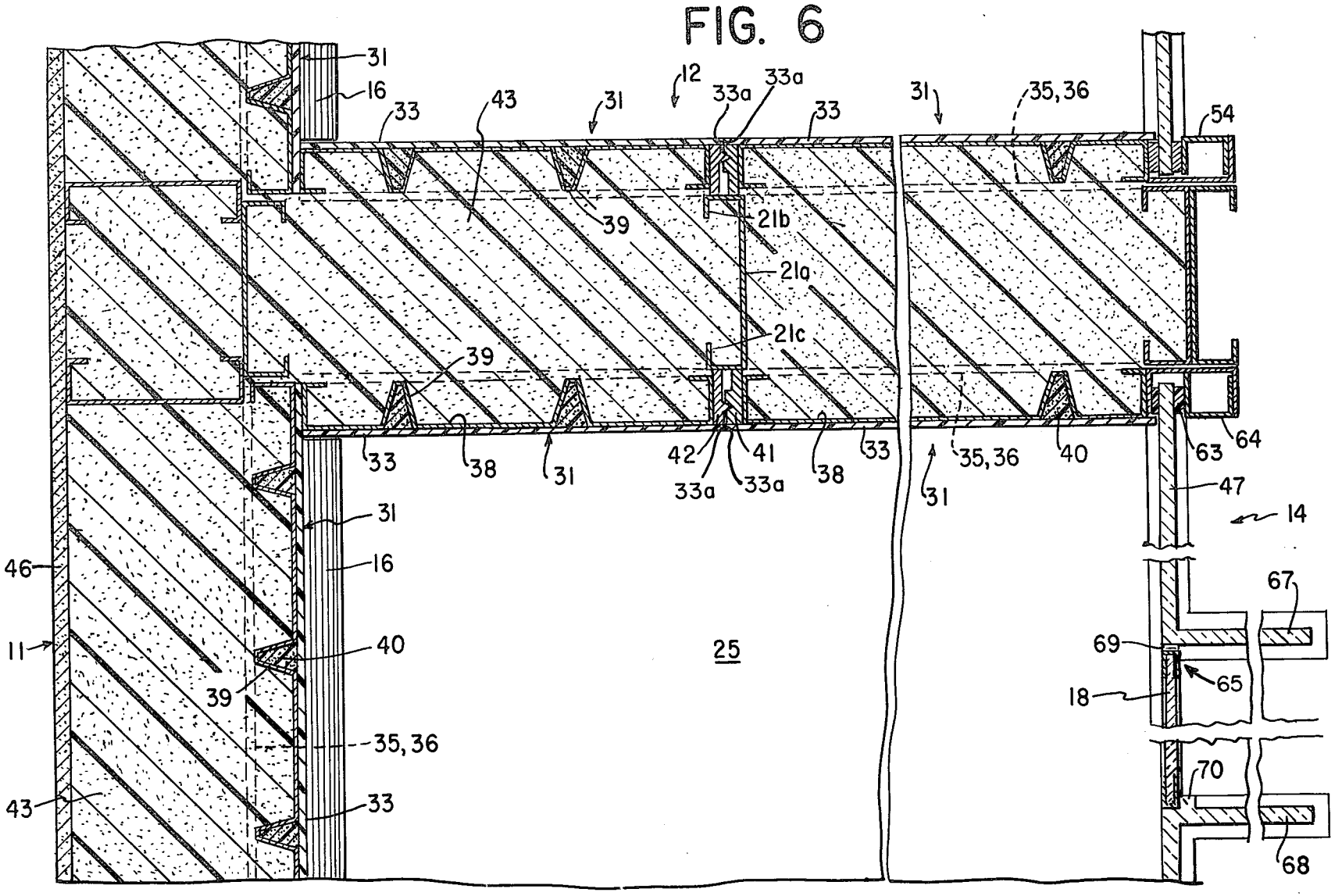
FIG. 6 is a view taken in the direction of arrows 6—6 of FIG. 2.
Figure 9:
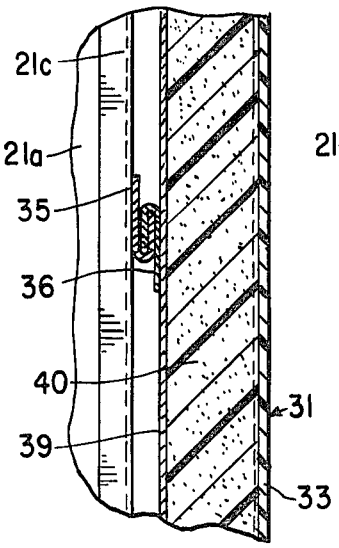
FIG. 9 is a detail showing the mounting of prefabricated panels to vertical studs.

Referring to FIGS. 5 and 6, it will be seen that directly behind the sheets 33 and bonded thereto by a suitable adhesive is a corrugated metal sheet 38 (which may be conventional roof decking) whose corrugations 39 are arranged vertically and extend for the full thickness of the panel 31. Strip 34 is backed by member 35 attached to the upper edge of a sheet 38 across the corrugations 39. The corrugations 39 are spaced apart at about six-inch intervals and are filled with a high density faom 40 (e.g. polyurethane). Stiffeners 35 are attached to and transversely across the apices of the corrugations extending for substantially the entire width of a panel 31. Referring to FIG. 9, it will be seen that mating "J" section clips 35 and 36 are welded respectively to the apices of selected corrugations 39 and to flanges **21*b* or 21*c* of studs 21, thus permitting panels 31** to be easily secured to the studs.

Figure 10:
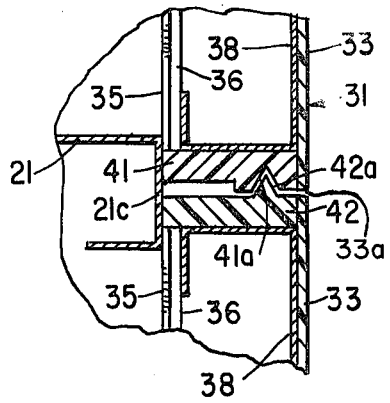
FIG. 10 is an enlarged detail of the joinder of adjacent prefabricated panels.
Figure 8:
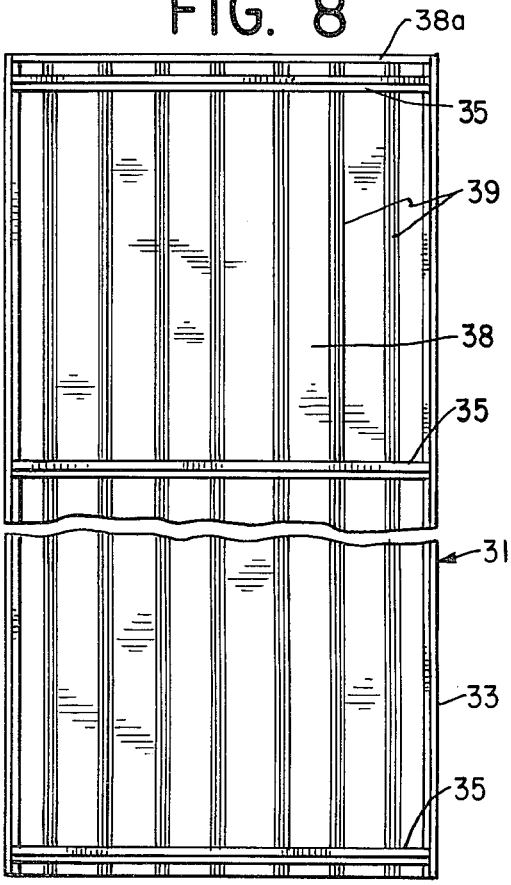
FIG. 8 illustrates the construction of a prefabricated panel in accordance with the present invention.

FIGS. 6 and 10 illustrate the method of joining together respective panels 31. Extruded aluminum strips 41, 42 are attached to the adjacent or abutting ends of each panel. Strip 41 defines a truncated V-shaped groove **41*a* which receives the truncated V-shaped projection 42*a* of strip 42. This method of joining panels 31 permits adjacent squared panels 31 of polycarbonate to abut tightly and imperceptibly. Also, since strips 41 and 42 are exactly dimensioned and underlie the edges 33*a* of adjacent sheets 33, the strips will effect precise alignment of sheets 33, i.e. will cause sheets 33 to be flush with respect to each other. After panels 31 have been installed, the space intermediate respective corrugations 39, including the space between studs 21, will be foam filled on site with a suitable low density foam 43**.

Figure 7:
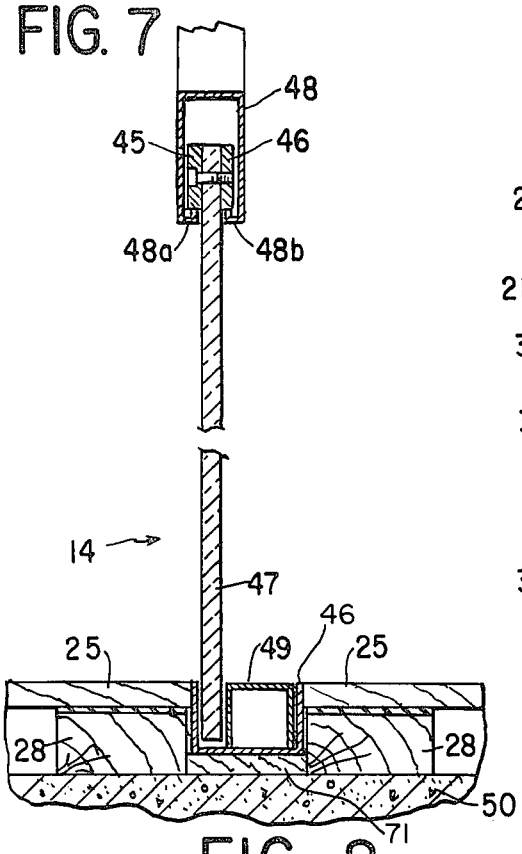
FIG. 7 is a vertical sectional view of one embodiment illustrating the construction of the rear wall of the court.

Referring now to FIG. 7, one method of constructing the rear wall 14 of the court 10 has been illustrated. In accordance with this embodiment, a sheet of polycarbonate 47, approximately one-half inch thick, is secured by being bolted along its upper edge to the adjacent encompassing channel 46. The latter is bolted to channel 48. Channel 48 extends between and is supported by the structure of the adjacent side walls 12 and 13. It will be seen that the lower edge of the sheet 47 is free to hang in a groove provided between flooring 25 and sleepers 28 in which is channel member 46. The latter rests upon member 71 secured to the foundation by bolts 72. Metal glazing frame 49 bolted to member 46 abuts one side of sheet 47 to secure the lower edge of the sheet 47. By this means, the sheet 47 is permitted to hang or depend from its retention within channel 48, and thus the hanging weight exerts tension upon the sheet 47. Such tension is desirable in achieving the proper resilience or bounce to the playing surface. Furthermore, since the lower edge of sheet 47 is not permitted to rest upon the foundation 50, the sheet may move freely to accommodate differences in temperature. The arrangement therefore has the characteristic of providing a straight playing surface whose characteristics are accentuated by hanging tension while also accommodating expansion or contraction of the sheet 47 which might otherwise cause buckling or distortion thereof.

Figure 11:
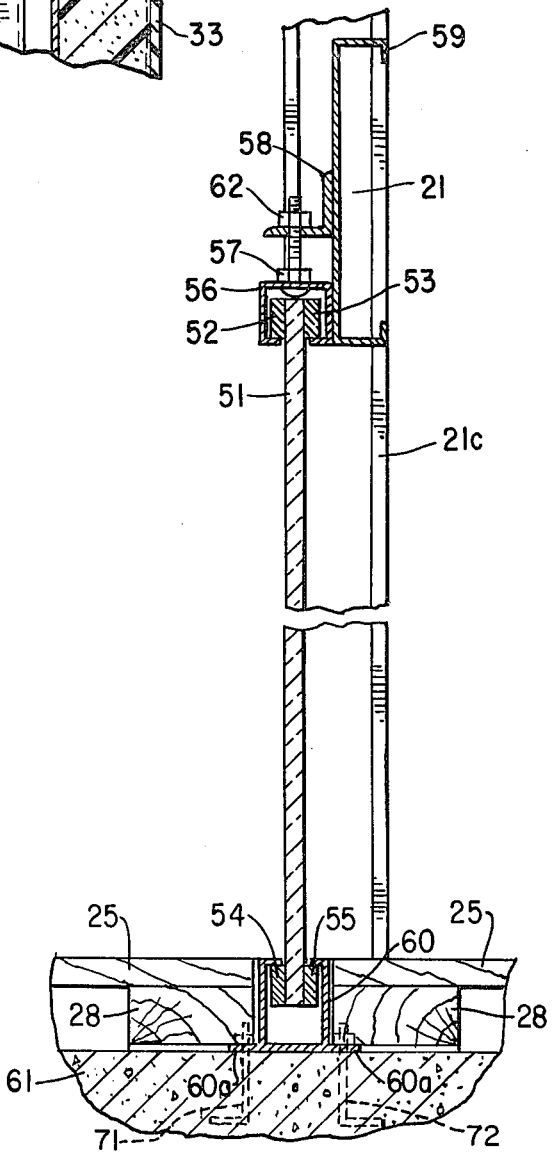
FIG. 11 is a vertical cross sectional view of an alternate form of construction of the rear wall of the court in accordance with the present invention.

Referring to FIG. 11, an alternate form of mounting the rear wall polycarbonate sheet has been illustrated. In this embodiment, the sheet 51 is joined along its upper and lower edges to adjacent members 52, 53, 54, 55. The upper edge and members 52 and 53 are contained within a channel 56, which is secured by an adjustable bolt 57 to angle 58, the latter being welded to transverse channel 59. Channel 59 extends laterally between side walls 12 and 13 at the predetermined height. The edge of sheet 51 and members 54 and 55 are retained within channel 60 whose lower flanges **60*a* are bolted to foundation 61. Accordingly, tension may be applied to sheet 51 by rotating nut 62 about bolt 57. The mounting is such that temperature variations will not cause buckling or distortion of the sheet 51**.

It will be seen with respect to FIG. 6 that the ends of sheet 47 adjacent to a side wall are secured between vertical silicon rubber strips 63 and by metal glazing frame 64. As best seen in FIGS. 11 and 12, centered with respect to the rear wall 14, or where otherwise convenient, is a door 18 within a frame 65. The opening therefore consists of sections 67 and 68, preferably of polycarbonate sheet, which extend perpendicularly from the rear wall 14. Door 18 is hinged at 69 in a conventional manner, swings inwardly and when closed will rest against stop 70.

In accordance with the foregoing description of a particular embodiment or embodiments, the playing court of the present invention may have the front and side walls and ceiling thereof constructed of prefabricated panels uniquely designed and able to function as inner facing or wall and ceiling playing surfaces. It has been found that relatively thin sheets of polycarbonate material will have the proper characteristics for play if properly supported. In the disclosed embodiment, prefabricated panels comprise polycarbonate sheets backed by corrugated sheets, the corrugations being filled with a high density foam. The respective panels include mating extruded aluminum strips along adjacent abutting edges which interlock to properly join the edges of respective panels so that the squared off polycarbonate sheets precisely abut to form a flush continuous playing surface. The panels are attached to vertical structural studs by clips secured to the studs and to the apices of the corrugations of the backing sheet. Support of the rear transparent wall is achieved by attaching the upper edge of polycarbonate sheets to and within a transverse channel member, the lower edges being restrained against lateral movement while the sheets are permitted to hang or are subjected to mechanical tension.

It will be understood that the foregoing description has been of particular embodiments of the invention and is therefore representative. In order to appreciate fully the scope of the invention, reference should be made to the appended claims.

We claim:

1. A playing court comprising a sports facility having a generally rectangular configuration to accommodate therein at least two persons playing a game wherein a resilient ball is played from one or more of the inner facing surfaces of said court, said court comprising at least front, rear and side walls wherein the improvement resides in constructing at least some of said walls of a plurality of prefabricated panels, each panel including an inner facing polycarbonate sheet each polycarbonate sheet having a backing layer of high density foam, panel reinforcing means attached to said sheet extending throughout said layer of high density foam, a plurality of spaced vertical studs for supporting and mounting said panels and sheets in adjoining relationship and fastening means for securing said reinforcing means to said studs to permit hanging of said panels on said studs.

2. A playing court according to claim 1 wherein said reinforcing means defines a plurality of corrugations, said corrugations being filled with high density foam.

3. A playing court according to claim 2 wherein adjoining strips are attached to the edges of said backing, said adjoining strips having means for interlocking said panels in adjacent flush relations.

4. A playing court according to claim 3 wherein the space between said studs and intermediate said corrugations is filled with a low density foam material.

5. A playing court according to claim 4 wherein panels mounted to form the upper wall surfaces of said court include a facing strip of polycarbonate material inclined toward said studs, and means for mounting said strip to said panels.

* * * * *